United States Patent [19]

Louw

[11] Patent Number: 4,830,237

[45] Date of Patent: May 16, 1989

[54] GARMENT HANGER

[76] Inventor: Henry J. Louw, Dreyersdal Road, Bergvliet, 7800, South Africa

[21] Appl. No.: 10,700

[22] Filed: Feb. 4, 1987

[30] Foreign Application Priority Data

Feb. 4, 1986 [ZA] South Africa ..... 86/0793

[51] Int. Cl.[4] ..... A47G 25/40; A47G 25/16

[52] U.S. Cl. ..... 223/89

[58] Field of Search ..... 223/69, 74, 85, 88, 223/89, 90, 94, 95; 38/102, 102.4

[56] References Cited

U.S. PATENT DOCUMENTS

| | | | |
|---|---|---|---|
| 998,530 | 7/1911 | Ketelsen | 38/102.4 |
| 1,049,871 | 1/1913 | Ketelsen | 38/102.4 |
| 1,159,270 | 11/1915 | Pugsley | 38/102.4 X |
| 2,729,371 | 1/1956 | Waldman | 223/89 |
| 2,929,538 | 3/1960 | Douglass | 223/94 X |
| 3,363,868 | 1/1968 | Okada | 223/94 X |
| 4,227,632 | 10/1980 | Collis | 223/94 |
| 4,438,874 | 3/1984 | Zuckerman et al. | 223/93 X |
| 4,673,115 | 6/1987 | LaMont | 223/95 X |

FOREIGN PATENT DOCUMENTS

| | | | |
|---|---|---|---|
| 605083 | 2/1926 | France | 223/90 |
| 136277 | 12/1919 | United Kingdom | 38/102 |
| 184693 | 8/1922 | United Kingdom | 38/102 |
| 201370 | 8/1923 | United Kingdom | 38/102 |

*Primary Examiner*—Robert R. Mackey

*Attorney, Agent, or Firm*—Larson & Taylor

[57] ABSTRACT

A hanger includes a suspension member, such as a hook, to suspend it from a support rail; a first or upper support member associated with the suspension member and adapted to support a garment, such as a jacket, a skirt, or a blouse. It further includes a second or lower support member adapted to support another associated garment, such as a pair of trousers, or a skirt; and joining means adapted to join the lower support member to the upper support member, the joining means being adjustable so as to vary the distance between the lower support member and the upper support member.

2 Claims, 3 Drawing Sheets

GARMENT HANGER

FIELD OF INVENTION

The present invention relates to hangers.

More particularly, the invention relates to hangers for supporting various garments.

BACKGROUND TO INVENTION

When hangers are used to support garments consisting of two associated parts, eg. a two-piece garment such as a jacket and a pair of trousers, it is normal practice to support the jacket or shirt on the supporting bar of the hanger and to attach the pair of trousers on the inside of the jacket by means of pins, support strips or the like.

It is cumbersome to attach the two parts or pieces of garments in this manner and often the final presentation thereof is not very attractive.

it is an object of the invention to suggest a hanger, which will assist in simplifying such display.

SUMMARY OF INVENTION

A hanger device comprising a single piece injection moulded integral plastic member, said member comprising:

(a) a suspension portion for suspending the hanger from a support rail;

(b) an upper support portion associated with the suspension portion for supporting a first garment;

(c) a lower support portion for supporting a second garment associated with the first garment;

(d) joining means for joining the lower support portion to the upper support portion and movable from an initial position in which the lower support portion is close to the upper support portion to an extended position in which the lower support portion is spaced away form the upper support portion, the joining means including a pair of scissor-like lever elements joined at their free ends respectively to the upper support portion and the lower support portion, and adjusting means for connecting the lever elements together at different crossing positions of the lever elements to allow the distance between the lower support portion and the upper support portion to be varied, each lever element including two elongated arms, the arms being hingedly connected together at one of their respective ends by integral flexible hinge portions, and one of the arms being hingedly connected to the upper support portion by an integral flexible hinge portion and the other arm being hingedly connected by an integral flexible hinge portion to the lower support portion; and (e) frangible connection means joining the upper support portion to the lower support portion when the lower support portion is in the initial position adjacent the upper support portion, and being frangible so as to permit the lower support portion to be moved away from the upper support portion into an extended position.

The joining means may include a pair of scissor-like lever elements or double pair of scissor-like lever elements joined at their free ends respectively to the upper support member and the lower support member, and the adjusting means being adapted at the crossing positions of the lever elements to lock them together for allowing the distance between the lower support member and the upper support member to be varied.

The suspension member, the upper support member, the lower support member, the joining member and the adjusting means may be formed integrally, eg. by thermoplastic injection moulding. Alternatively, these parts may be produced separately and then assembled together.

BRIEF DESCRIPTION OF DRAWINGS

The invention will now be described by way of example with reference to the accompanying schematic drawings.

In the drawings, there is shown in

DETAILED DESCRIPTION OF DRAWINGS

Figure 1:
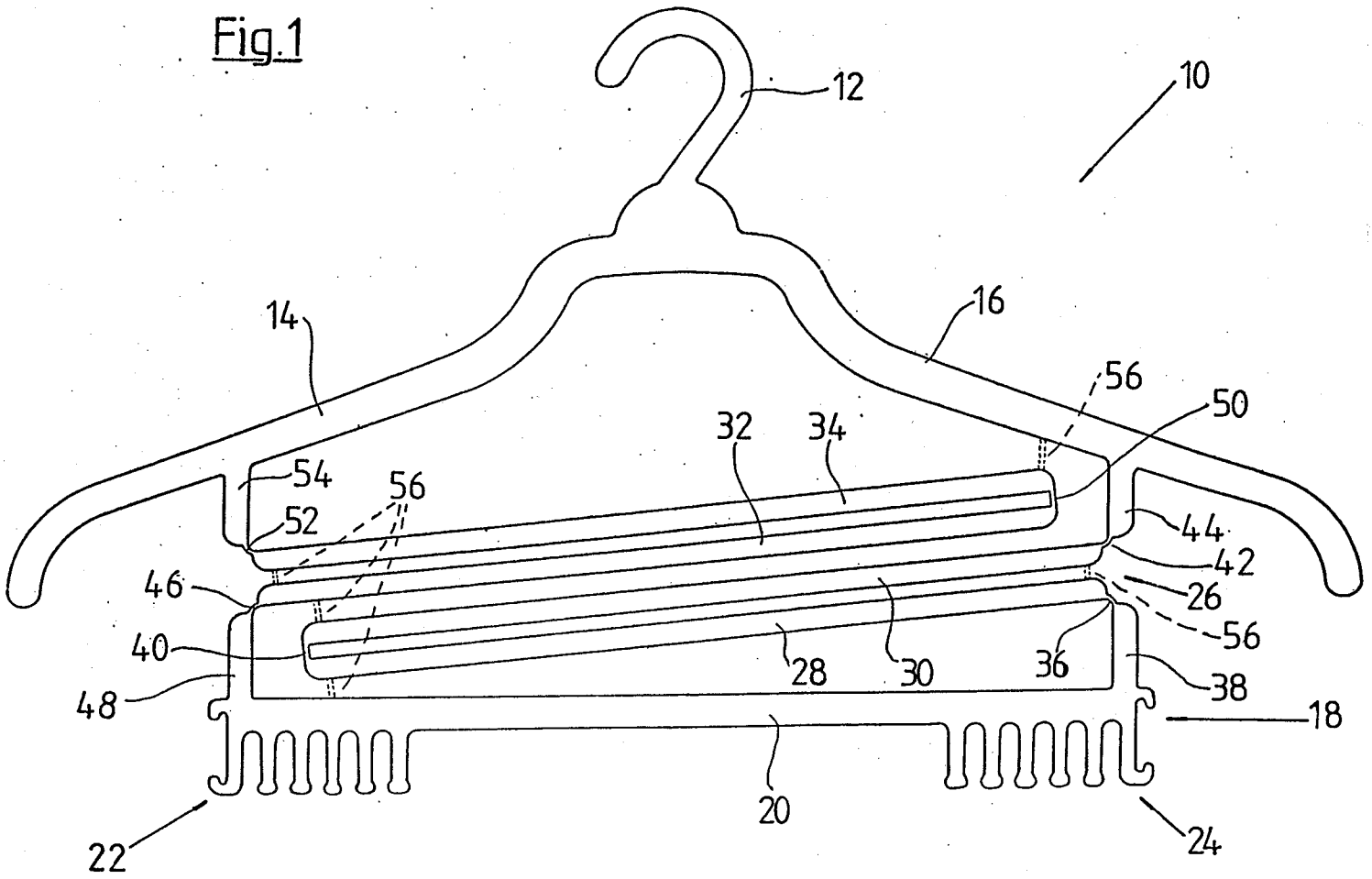
FIG. 1 a side view of a hanger in accordance with the invention and being in the condition when produced and prior to use.

Referring to FIG. 1, the hanger 10 includes a suspension hook 12 joined to the upper support member including the two support arms 14, 16.

Below the two upper support arms 14, 16, the lower support member or bar, generally indicated by reference numeral 18, is located. It consists of a bar 20 having at both opposite ends a number of garment support hooks 22 and 24, respectively. The hooks 22, 24 are used to support garments as will be described in more detail below.

The support bar 20 is joined to the upper support arms 14, 16 by means of the joining member, generally indicated by reference numeral 26. The joining member 26 includes two pairs of flat legs 28, 30 and 32, 34.

The leg 28 is joined by section 36 to the arm 38 of the lower support member 18. The two legs 28 and 30 are joined by section 40 and the leg 30 is joined by section 42 to a suspension arm 44 joined to the upper arm 16.

On the opposite side, the leg 32 is joined by section 46 to the arm 48 extending from the bar 20, and at its opposite end is joined by means of the section 50 to the arm 34. The free end of the arm 34 is joined by means of the section 52 to the suspension arm 54 attached to the upper arm 14. All the joining sections 36, 40, 42, 46, 50, 52, form hinges between the respective arms, legs, etc. joined by them.

If required thin, rupturable or frangible joining pieces may be provided at one or more of the positions indicated by dotted lines 56 to hold the arms, legs, etc. together during transportation but being rupturable prior to use of the hanger 10 to hang garments.

Figure 2:
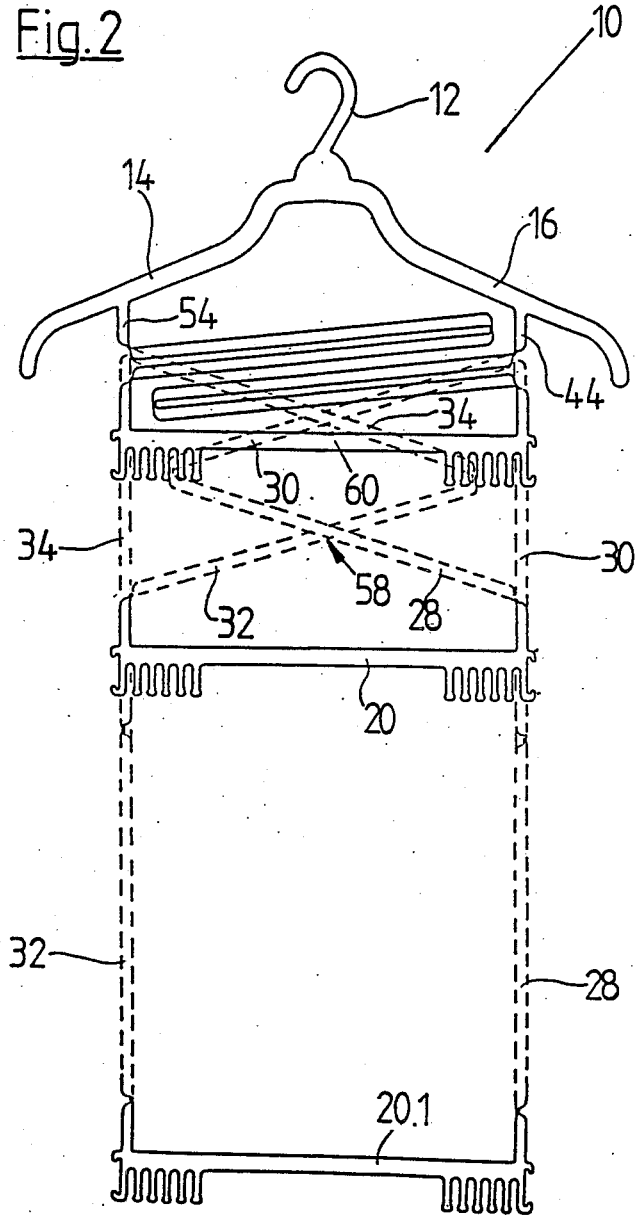
FIG. 2 on a reduced scale, the hanger illustrated in FIG. 1 showing it in various positions of use.

Referring now to FIG. 2, the upper part of the drawing shows the hanger 10 in its original condition (as illustrated in FIG. 10. When two pieces of garments are to be suspended therefrom, the bar 20 is moved down to be correctly distanced from the arms 14 and 16. Then the legs 28, 32, and 30, 34 will cross at the positions indicated by reference numerals 58 and 60. At these positions, connection formations are provided for connecting the two arms together. This can be done by stubs and holes, gripping rail formations, etc. A series of such associated connection formations are provided on the legs 28, 30, 32, 34 for varying the distance of the bar 20 from the upper arms 14, 16 as may be desired.

When in the desired position, the lower garment piece is attached to or suspended from the bar 20 and thereafter the upper garment piece is suspended from the arms 14 and 16.

The two garment items then can be suspended by means of the suspension hook 12 from a fail as may be desired.

The maximum extension is obtained when the bar 20 is in the position referred to by reference numeral 20.1. When in this position, the arms 28, 30 and 32, 34 will extend down straight from above.

At its outer upper ends, the bar 20 carries end hooks 61, which prevent a garment, fitted to the bar 20, from slipping upwardly over the ends of the support bar 20.

The garment support hooks 22, 24 are intended in particular to support and display garments being of tubular shape in cross-section and having an elastic section or strip at one end, eg. as is the case with panties or briefs. These garments are provided in different sizes and thereby have different diameters so as to be worn by persons with different waistlines. By means of the support hooks 22, 24 garments of different sizes can be fitted to the same type and size of hanger and the fitted garments all will have the same width appearance. In FIGS. 3 to 9, different garment support hooks at one end of a support bar 20 are shown.

Similar elements would be provided at the opposite end of the support bar 20.

In FIGS. 3 to 9, the same reference numeral will be used as in FIGS. 1 and 2 to indicate the same or similar parts, the bar 20 being referred to as bar 20.2, 20.3 etc.

Figure 3:
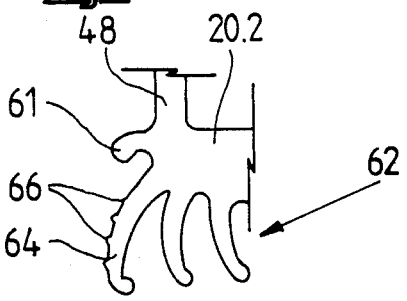
FIGS. 3 to 9 on an enlarged scale, side views of one end of the hanger bar of the hanger of FIGS. 1 and 2 but showing different garment support hooks in accordance with the invention.

FIG. 3 shows support elements comprising a hook formation 64 directed to the hanger center and further having at its outwardly directed face, a number of protrusions 66, which are intended to assist in gripping garments to hold them in a non-slip manner on the hanger.

Figure 4:
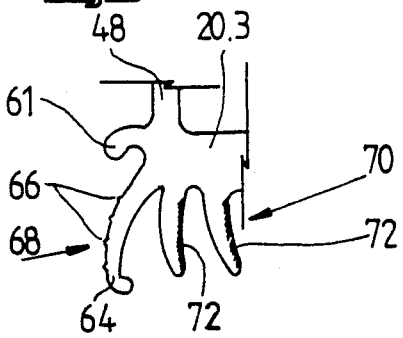

FIG. 4 shows a type of garment support elements 68 having hooks 70 with a sticky or roughened non-slip surface 72 facing towards the hanger center of the support bar 20.3.

Figure 5:
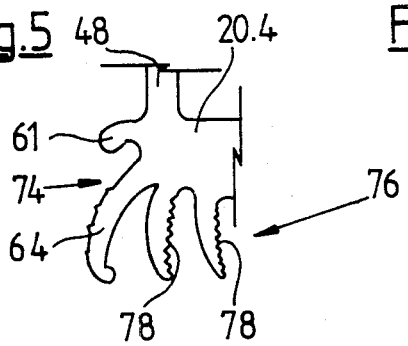

FIG. 5 shows another type of support hooks 74 having hooks 76 with a serrated surface 78 facing towards the hanger center of the support bar 20.4.

Figure 6:
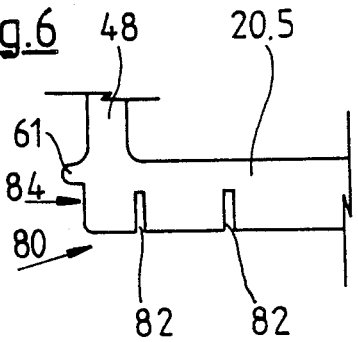

In FIG. 6, another type of support hook is shown in schematic form. Here the support hooks 80 are formed by gaps or slots 82 in a support bar 20.5. For fitting a garment, the flat-folded garment is merely inserted into a garment gap 82 and the garment then is pulled in the direction away from the bar center of the bar 20.5, is folded over the bar end 84, is pulled towards the other bar end, folded over that end and fitted into a similar gap provided at that end.

Figure 7:
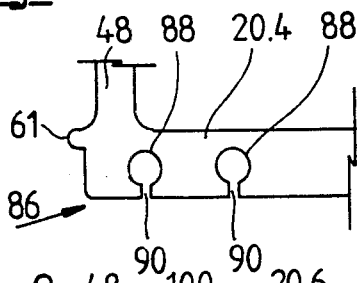

The support hooks 86 of the bar 20.6 in FIG. 7 are formed by circular cut-outs 88, each having a narrow insertion throat 90. The function thereof if similar to the hooks 80 of FIG. 6.

Figure 8:
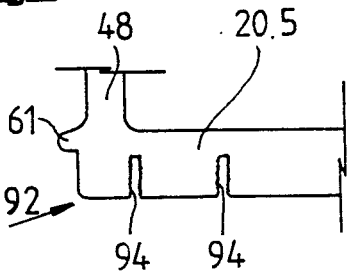

In FIG. 8, the support hooks 92 are formed by slots 94 provided in the support bar 20.7, the slots 94 having serrated edges to facilitate gripping of a garment placed therein.

Figure 9:
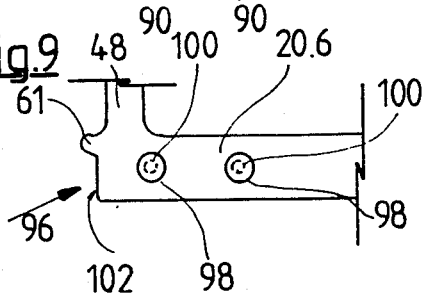

Finally, as is shown in FIG. 9, the bar 20.8 is provided with support hooks 96 in the form of knobs 98 supported by pins 100. A garment is merely hooked over such a knob 98 and is pulled towards the end 102 of the bar 20.8 for fitting (as described with reference to FIG. 6).

The hooks 22, 24 of FIGS. 1 and 2 or those illustrated in FIGS. 3 to 9 may be replaced by suitable pegs, springloaded clamps, clips, expanding waist band clamp or any other suitable garment support means.

The garment hangers as illustrated in the various drawings may be injection moulded from any suitable synthetic plastic material (such as polypropylene, high density polyethylene, polystyrene or A.B.S) and are of substantially flat form.

I claim:

1. A hanger device comprising a single piece injection moulded integral plastic member, said member comprising:

(a) a suspension portion for suspending the hanger from a support rail;

(b) an upper support portion associated with the suspension portion for supporting a first garment;

(c) a lower support portion for supporting a second garment associated with the first garment;

(d) joining means for joining the lower support portion to the upper support portion and movable from an initial position in which the lower support portion is close to the upper support portion to an extended position in which the lower support portion is spaced away form the upper support portion, the joining means including at least one a pair of scissor-like lever elements joined at their free ends respectively to the upper support portion and the lower support portion, and adjusting means for connecting the lever elements together at different crossing positions of the lever elements to allow the distance between the lower support portion and the upper support portion to be varied, each lever element pair including two elongated arms, the arms being hingedly connected together at one of their respective ends by integral flexible hinge portions, and one of the arms being hingedly connected to the upper support portion by an integral flexible hinge portion and the other arm being hingedly connected by an integral flexible hinge portion to the lower support portion; and (e) frangible connection means joining the upper support portion to the lower support portion when the lower support portion is in the initial position adjacent the upper support portion, and being frangible so as to permit the lower support portion to be moved away from the upper support portion into an extended position.

2. A hanger device as claimed in claim 1, in which the joining means comprises a double pair of said scissor-like lever elements.

* * * * *